US005419409A

United States Patent [19]

Corulla

[11] Patent Number: 5,419,409

[45] Date of Patent: May 30, 1995

[54] LADDER WITH ELECTRICAL SUPPLY AND FLIP TOP TOOL HOLDER

[76] Inventor: Eugene K. Corulla, 70 Seymour Ave., Staten Island, N.Y. 10302

[21] Appl. No.: 172,722

[22] Filed: Dec. 27, 1993

[51] Int. Cl.[6] ..... E06C 7/14

[52] U.S. Cl. ..... 182/129; 182/174

[58] Field of Search ..... 182/129, 180, 165-176

[56] References Cited

U.S. PATENT DOCUMENTS

| | | | |
|---|---|---|---|
| 845,433 | 2/1907 | Peltier | 182/167 X |
| 1,021,094 | 3/1912 | Goetter | 182/176 X |
| 1,373,173 | 3/1921 | Dazinskiene | 182/175 X |
| 2,109,886 | 3/1938 | Lewis | 182/129 X |
| 2,425,025 | 8/1947 | Boisselier | 182/129 X |
| 3,057,431 | 10/1962 | George | 182/129 X |
| 4,494,627 | 1/1985 | Arent | 182/129 |
| 4,653,713 | 3/1987 | Hamilton | 248/238 |
| 4,874,147 | 10/1989 | Ory et al. | 248/210 |
| 5,058,707 | 10/1991 | Waid | 182/120 |

FOREIGN PATENT DOCUMENTS

| | | | |
|---|---|---|---|
| 3150915 | 6/1983 | Germany | 182/129 |

*Primary Examiner*—Alvin C. Chin-Shue
*Attorney, Agent, or Firm*—Richard L. Miller

[57] ABSTRACT

A ladder with an electrical supply and a flip top tool holder is provided, which consists of a pair of front side rails with a plurality of steps supported by and between the front side rails. A head step is mounted to the top ends of the front side rails, while a pair of rear support legs are hinged to the head step. A pair of spreaders are provided, with each extending between one of the front side rails and one of the rear support legs, so as to keep the ladder in a self standing position. A component is carried in the head step, for supplying electrical current therefrom. A structure is coupled to the head step, for holding various tools thereto, for use by a person at the ladder.

1 Claim, 1 Drawing Sheet

LADDER WITH ELECTRICAL SUPPLY AND FLIP TOP TOOL HOLDER

BACKGROUND OF THE INVENTION

The instant invention relates generally to stepladder tool trays and more specifically it relates to a ladder with an electrical supply and a flip top tool holder.

Numerous stepladder tool trays have been provided in prior art that are adapted to be attached in a removable manner to stepladders, so that after attachment thereto various tools can now be held within the tool trays. For example, U.S. Pat. Nos. 4,653,713 to Hamilton; 4,874,147 to Ory et al. and 5,058,707 to Wald all are illustrative of such prior art. While these units may be suitable for the particular purpose to which they address, they would not be as suitable for the purposes of the present invention as heretofore described.

SUMMARY OF THE INVENTION

A primary object of the present invention is to provide a ladder with an electrical supply and a flip top tool holder that will overcome the shortcomings of the prior art devices.

Another object is to provide a ladder with an electrical supply and a flip top tool holder that is permanently constructed as one complete unit, so that the tool holder is maintained with the ladder at all times.

An additional object is to provide a ladder with an electrical supply and a flip top tool holder that contains a built in electrical receptacle which enables a person to use electrical power tools carried in the tool holder without getting the electrical cords tangled around each other and the ladder.

A further object is to provide a ladder with an electrical supply and a flip to tool holder that is simple and easy to use.

A still further object is to provide a ladder with an electrical supply and a flip top tool holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The FIGURES on the drawings are briefly described as follows.

DETAILED DESCRIPTION OF THE PREFERRED EMBODIMENTS

Figure 1:
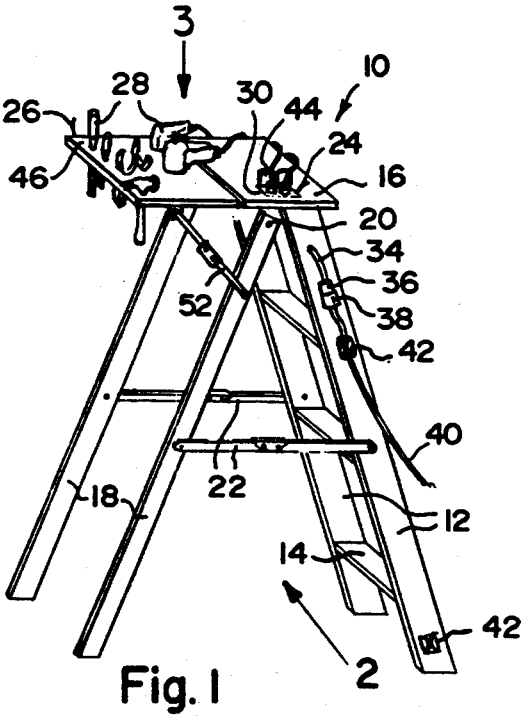
FIG. 1 is a diagrammatic perspective view of the instant invention standing open ready for use.

Turning now descriptively to the drawings, in which similar reference characters denote similar elements throughout the several views, FIGS. 1 through 5 illustrate a ladder with an electrical supply and a flip top tool holder 10, which consists of a pair of front side rails 12, with a plurality of steps 14 supported by and between the front side rails 12. A head step 16 is mounted to the top ends of the front side rails 12, while a pair of rear support legs 18, so as to keep the ladder 10 in a self standing position, as shown in FIG. 1. A component 24 is carried in the head step 16, for supplying electrical current therefrom. A structure 26 is coupled to the head step 16, for holding various tools 28 thereto for use by a person at the ladder 10.

The electrical current supplying component 24 includes the head step 16 having an aperture 28 therethrough. An electrical outlet 30 is mounted within the aperture 28 in the head step 16. The outlet 30 has two receptacles 32, each for receiving a male plug 33 from an electric power tool and other electrical operated articles. An electrical cord 34 is connected to the electrical outlet and extends out through the top end of the first front side rail 12. A male plug 36 is connected to a free end of the electrical cord 34, to engage with a female socket 38 on an extension cord 40 from a remote power source. At least one clip 42 is mounted on the first front side rail 12, so as to retain the extension cord 40 thereto. A pair of covers 44 are hinged to the two receptacles 32 in the electrical outlet 30, so as to protect the two receptacles 32 when the covers 44 are closed.

Figure 2:
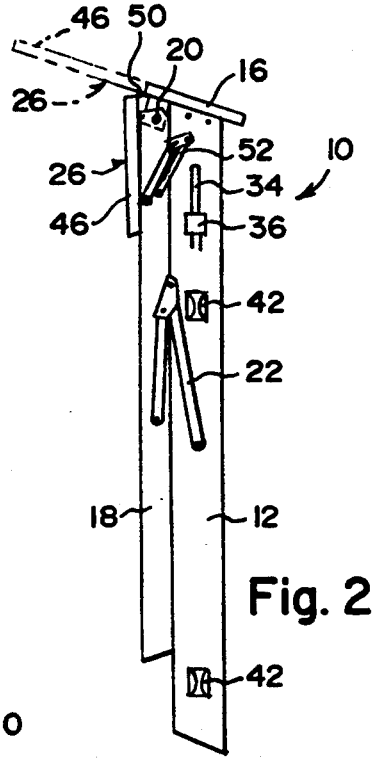
FIG. 2 is an enlarged elevational view taken in the direction of arrow 2 in FIG. 1 with the instant invention folded ready for storing.
Figure 3:
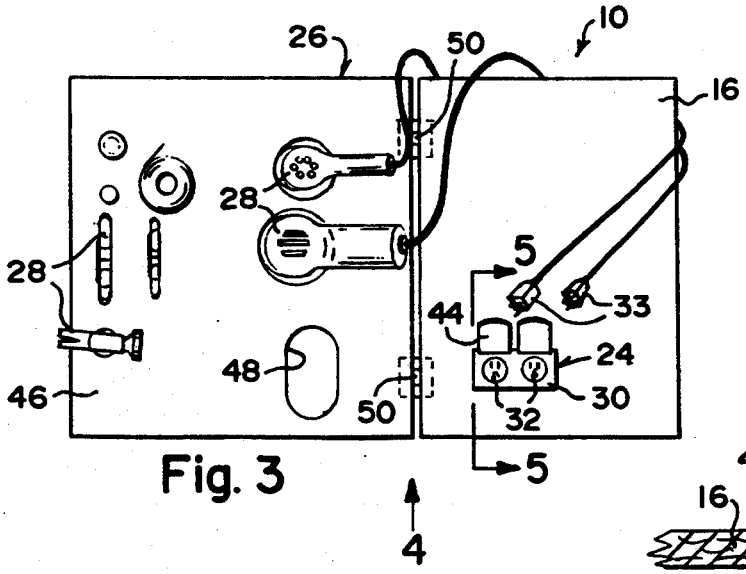
FIG. 3 is a further enlarged top elevational view taken in the direction of arrow 3 in FIG. 1.
Figure 5:
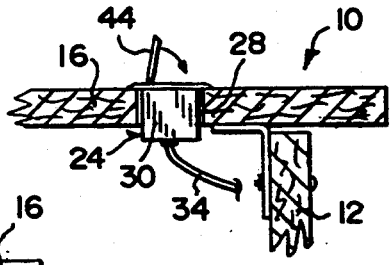
FIG. 5 is a cross sectional view with parts broken away taken on line 5—5 in FIG. 4.
Figure 4:
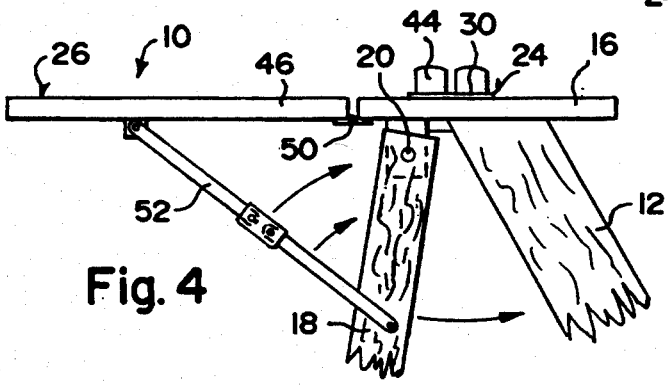
FIG. 4 is a side elevational view taken in the direction of arrow 4 in FIG. 3 with parts broken away illustrating the folding platform in greater detail.

The tool holding structure 26 contains a platform 46 having a plurality of various sized and shaped holes 48 therethrough, for holding the various tools thereto. Some of the tools 28 can be the electric power tools, used in conjunction with the electrical outlet 30. A pair of hinges 50 are for attaching the platform 46 to one side of the head step 16, above the rear support legs 18, so that the platform 46 can be folded down for storage as shown in FIG. 2. A pair of drop rail locks 52 are provided, with each extending between one side of the platform 46 and one rear support leg 18. The drop rail locks 52 when opened, will keep the platform 46 in an extended horizontal useable position with respect to the head step 16.

OPERATION OF THE INVENTION

To use the ladder 10 a person simply opens the ladder as shown in FIG. 1. The platform 46 is retained in a horizontal position when the drop rail locks 52 are opened. The various tools 28 can be inserted in the holes 48. The tools 28 can be a screwdriver, pliers, hammer and similar articles. The tools 28 can also be electric power tools with their respective male plugs 33 inserted into the receptacles 32 in the electrical outlet 30. The tools 28 can now be easily utilized from the platform 46 with the electrical cords of the electric power tools prevented from becoming tangled around each other and the ladder 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ladder with an electrical supply and a flip top tool holder which comprises:

a) a pair of front side rails;

b) a plurality of steps supported by and between said front side rails;

c) a head step mounted to the top ends of said front side rails;

d) a pair of rear support legs hinged to said head step;

e) a pair of spreaders, each extending between one of said front side rails and one of said rear support legs, so as to keep said ladder in a self standing position;

f) means carried in said head step for supporting an electrical current means therefrom comprising an aperture formed through said head step and an electrical outlet mounted within said aperture, said electrical outlet having two upward opening receptacles, each for receiving a male plug from an electric power tool and other electrically operated articles, and a pair of covers hinged to said two receptacles in said electrical outlet, so as to protect said two receptacles when said covers are closed; an electrical cord connected to said electrical outlet and extending out through the top end of a first front side rail; a mail plug connected to a free end of said electrical cord, to engage with a female socket on an extension cord from a remote power source; at least one clip mounted on said first front side rail, so as to retain the extension cord thereto;

g) means coupled to said head step, for holding various tools thereto, for use by a person at said ladder, the tool holding means including a platform having a plurality of various sized and shaped holes therethrough for holding the various tools thereto, in which at least some of the tools can be the electric power tools, used in conjunction with said electrical outlet; a pair of hinges for attaching said platform to one side of said head step above said rear support legs, so that said platform can be folded down for storage; and a pair of drop rail locks, each extending between one side of said platform and one said rear support leg, so that said drop rail locks when opened will keep said platform in an extended horizontal useable position with respect to said head step.

* * * * *